United States Patent [19]

Pearson et al.

[11] 4,360,424

[45] Nov. 23, 1982

[54] SLUICE BOX

[75] Inventors: Norman A. Pearson, 4862 Bessborough Dr., Burnaby, British Columbia, Canada; Gary W. Crawford, North Vancouver, Canada

[73] Assignee: Norman Anthony Pearson, Burnaby, Canada

[21] Appl. No.: 255,779

[22] Filed: Apr. 20, 1981

[51] Int. Cl.[3] ..... B03B 7/00

[52] U.S. Cl. ..... 209/44; 209/380; 209/498; 209/458; 209/500

[58] Field of Search ..... 209/44, 498, 499, 500, 209/414, 415, 380, 561, 564.13, 458, 460; 137/625.3; 198/535, 536, 565; 193/17

[56] References Cited

U.S. PATENT DOCUMENTS

| | | | |
|---|---|---|---|
| 189,928 | 4/1877 | Evans | 209/498 X |
| 255,160 | 3/1882 | Garvin | 209/498 X |
| 759,725 | 5/1904 | Turner | 209/498 |
| 886,152 | 4/1908 | Pfau | 209/499 |
| 967,826 | 8/1910 | Ormsby | 209/414 |
| 1,041,486 | 10/1912 | King | 209/44 X |
| 1,050,357 | 1/1913 | Toltz | 193/17 X |
| 1,243,122 | 10/1917 | Winters | 137/625.3 X |
| 1,752,169 | 3/1930 | Goody | 209/458 |
| 2,078,275 | 4/1937 | Prins | 209/44 X |
| 2,174,925 | 10/1939 | McKeerel | 209/44 |
| 2,191,322 | 2/1940 | Matthews | 198/535 X |
| 2,312,477 | 3/1943 | Pollitz | 209/329 |
| 2,443,071 | 6/1948 | Honerkemp | 137/625.3 |
| 2,724,497 | 11/1955 | Anderson | 209/499 X |
| 2,839,970 | 6/1958 | Gaffney | 209/380 |
| 3,075,644 | 1/1963 | Ambrose | 209/415 |
| 3,103,941 | 9/1963 | Watters | 137/625.3 X |
| 4,199,441 | 4/1980 | Ross | 209/44 |

FOREIGN PATENT DOCUMENTS

| | | | |
|---|---|---|---|
| 452050 | 9/1976 | Fed. Rep. of Germany | 209/498 |

*Primary Examiner*—David L. Lacey
*Attorney, Agent, or Firm*—Carver & Co.

[57] ABSTRACT

A sluice box apparatus for recovering heavy material, such as gold, comprises a fine recovery channel and a coarse recovery channel. The recovery channels have receiving ends, riffles and matting for collecting fines of the material. A hopper at the receiving end of the channels has a receiving end for aggregate, a discharge end adjacent the receiving ends of the channels, a bottom, an open top and water distributing means near the top and the discharge end for washing fines from the aggregate. A perforated plate extends substantially across the hopper near the discharge end. The plate is spaced-apart from the bottom. There is a coarse material discharge opening adjacent the coarse recovery channel for a flow of water and aggregate passing over the perforated plate to the coarse recovery channel and a fine material discharge opening between the bottom end and the perforated plate and adjacent the fine recovery channel. The fine material opening allows a flow of water and fine material passing through the perforated plate to enter the fine recovery channel. There is means for restricting the flow of water through the fine discharge opening to the fine recovery channel.

22 Claims, 7 Drawing Figures

SLUICE BOX

BACKGROUND OF THE INVENTION

This invention relates to a sluice box apparatus for recovering heavy material, such as gold, from an aggregate.

Placer gold deposits are found in areas where veins and lodes of gold have been exposed and eroded due to such forces as glaciers, water and rock slides. Such deposits are found, for example, in certain areas of the Yukon Territory and the province of British Columbia, Canada.

Several different techniques have been developed over many years for separating placer gold from the surrounding aggregate. Prospectors traditionally use a gold pan in creek beds.

A larger scale placer mining operation requires an apparatus such as a sluice box. This consists of a trough placed on an incline and having riffles on the bottom thereof. The riffles are blocks or laterally extending bars for catching the gold. The riffles are commonly placed on top of matting, such as coco mat or indoor/outdoor carpets, which traps the finer gold particles. In use, a stream of water flows along the sluice and gold bearing aggregate is added to the sluice. The gold particles are trapped by the riffles and matting, while the remaining aggregate and water is discharged at the end of the sluice.

Large gold dredges were used for placer mining in the Yukon from the early to mid twentieth century. These dredges commonly used a large revolving screen, or trommel, where the gold-bearing aggregate was washed. The finer gravel passing through the revolving screen was discharged onto a table with a plurality of curved veins for distributing the gravel to a plurality of sluices.

A similar arrangement is seen in U.S. Pat. No. 1,041,486 to King et al. This patent discloses a gold saving table which includes a hopper for receiving material passing through the foraminous wall of a screen, for example a rotary screen. The material from the distributing hopper is discharged onto a gold saving table having a series of channels formed thereon by upwardly extending veins. The channels extend laterally and curve forwardly in a U-shaped arrangement. There are perforated plates at the ends of the channels through which finer particles pass. An auxiliary gold saving table is provided to separate lighter particles.

Canadian Pat. No. 1,074,263 to Ross discloses a similar arrangement employing a distribution table and a separate fine recovery section. The distribution table has a floor transversely downwardly inclined and longitudinally upwardly inclined to slow the fine flurry stream. While the Ross device employs a fixed central recovery channel for coarse material and fixed recovery channels on each side thereof for fine materials, the patent does discuss the possibility that the slope of the fine and coarse recovery channels could be made independently adjustable.

Because the price of gold has increased dramatically in recent years, it has become increasingly important to improve the recovery of gold from such placer mining devices. The devices used in early years were relatively inefficient and a considerable amount of gold, particularly fine material and gold flour, was discharged from the sluice boxes or other devices. For example, in the Ross device found in Canadian Pat. No. 1,074,263, a superfine recovery section has been added to the lower portion of the fine recovery channels to attempt to recover fine material not recovered by the upper portion of the device. However, the need for an inherently more efficient placer mining device remained.

SUMMARY OF THE INVENTION

According to the invention, a sluice box apparatus for recovering heavy materials, such as gold, comprises a fine recovery channel and a coarse recovery channel. The recovery channels have a receiving end, riffles and matting for collecting fines of the material. A hopper at the receiving ends of the channels has a receiving end for aggregate, a discharge end adjacent the receiving ends of the channels, a bottom, an open top and water distributing means near the top and the discharge end for washing fines from the aggregate. A perforated plate extends substantially across the hopper near the discharge end. The plate is spaced-apart from the bottom. There is a coarse material discharge opening adjacent the coarse recovery channel for a flow of water and aggregate passing over the perforated plate to the coarse recovery channel. There is a fine discharge opening between the bottom and the perforated plate and adjacent the fine recovery channel. The fine material opening allows a flow of water and fine material passing through the perforated plate to enter the fine recovery channel. There is means for restricting the flow of water through the fine discharge opening to the fine recovery channel.

By double washing the aggregate with the water discharged from the water distributing means and with the water circulating upwardly through the perforations in the perforated plate, a considerably more efficient sluice box apparatus results. The upwardly circulating water occurs because of the restricted flow of water through the fine discharge opening. A higher portion of fine materials are washed from the aggregate and pass through the perforations to the fine recovery channel instead of being discharged into the coarse recovery channel. The fine recovery channel may be specifically adapted for the recovery of gold from such fines. The means for restricting the flow of water to the fine recovery channel allows the flow to be adjusted for optimal recovery of fines. Other advantages of the invention will become clear with reference to the description of the preferred embodiment outlined below.

DESCRIPTION OF THE PREFERRED EMBODIMENTS

Figure 1:
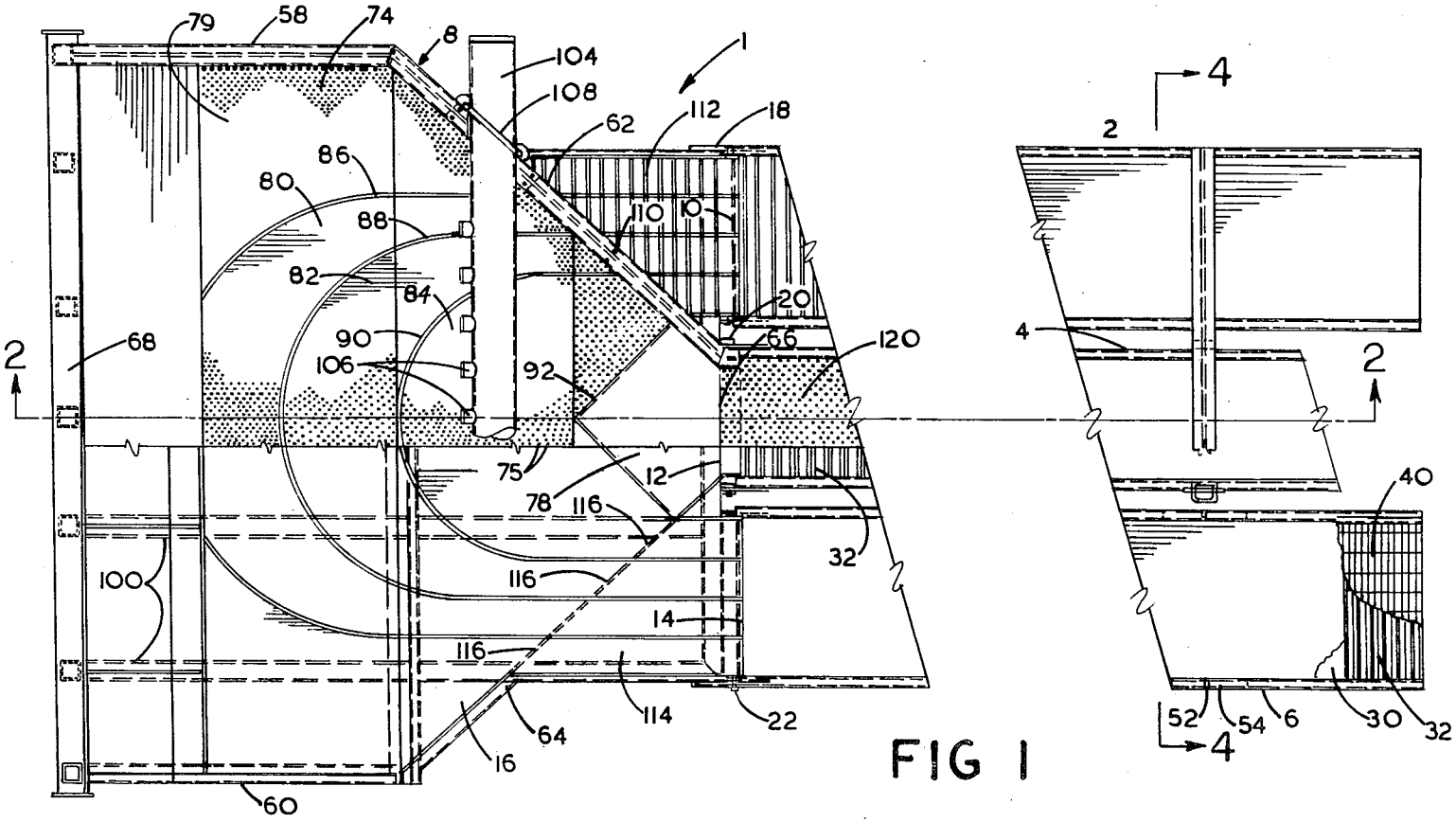
FIG. 1 is a top plan view of a sluice box apparatus according to an embodiment of the invention with portions thereof partly broken away.

The drawings illustrate a sluice box apparatus 1 including three parallel recovery channels 2, 4 and 6. There is a hopper 8 adjacent the receiving ends 10, 12 and 14 of the channels 2, 4 and 6, respectively. The hopper has a flat bottom 16 which forms a distributing table for the sluice box apparatus and extends forwardly to the three channels.

Figure 7:
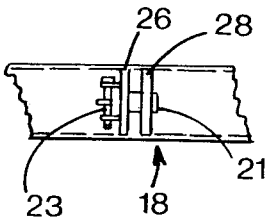
FIG. 7 is a fragmentary view showing the hinged connection of FIG. 6 in front elevation.
Figure 6:
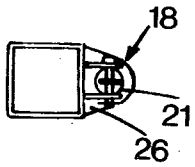
FIG. 6 is an enlarged fragmentary side elevational view showing the hinged connection between the recovery channels and the hopper.

The channels 2, 4 and 6 have hinged connections 18, 20 and 22, respectively, on their receiving ends adjacent the hopper for connecting the channels to the bottom 16. Referring to FIGS. 6 and 7, which show one side of the hinged connection 18, it may be seen that each hinged connection consists of a pair of removable hinge pins 21 on opposite sides of the channel. Each of the pins 21 is received within a suitably apertured lug 26 of the channel and a corresponding lug 28 on the bottom 16. A lock pin 23 passing through an aperture in the hinge pin 21 keeps the hinge pin in position. Clearly, by removing all of the lock pins 23 and then knocking out the hinge pin 21, the channels can be removed so the apparatus can be knocked down for transport.

Figure 2:
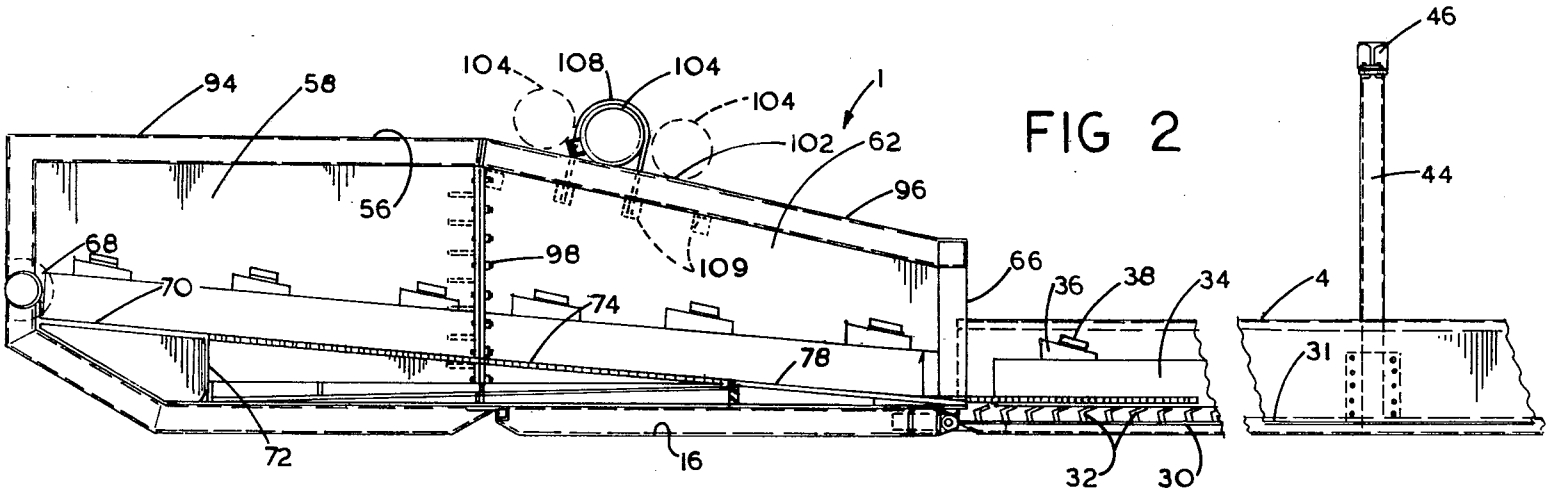
FIG. 2 is a sectional view of the apparatus taken along Line 2—2 of FIG. 1.
Figure 3:
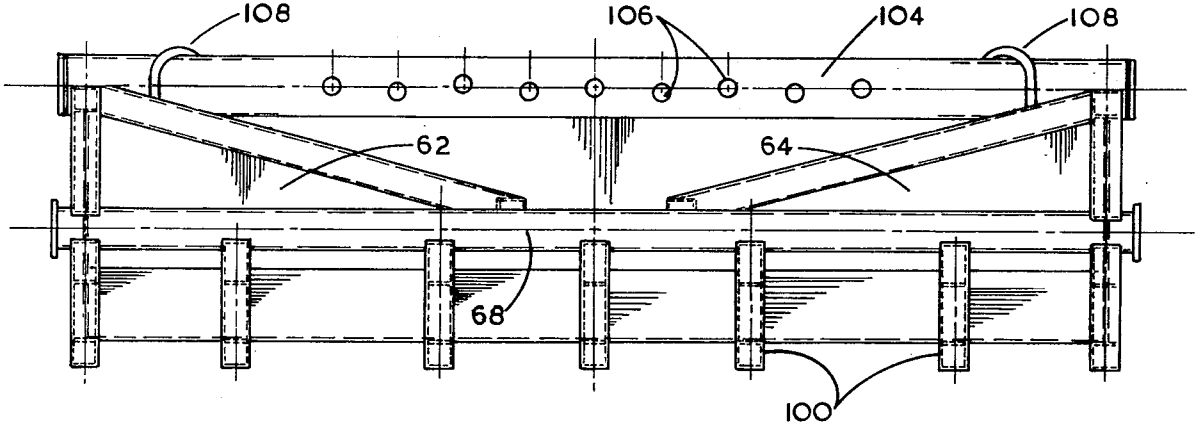
FIG. 3 is a rear elevational view of the hopper of the apparatus shown in FIG. 1.
Figure 4:
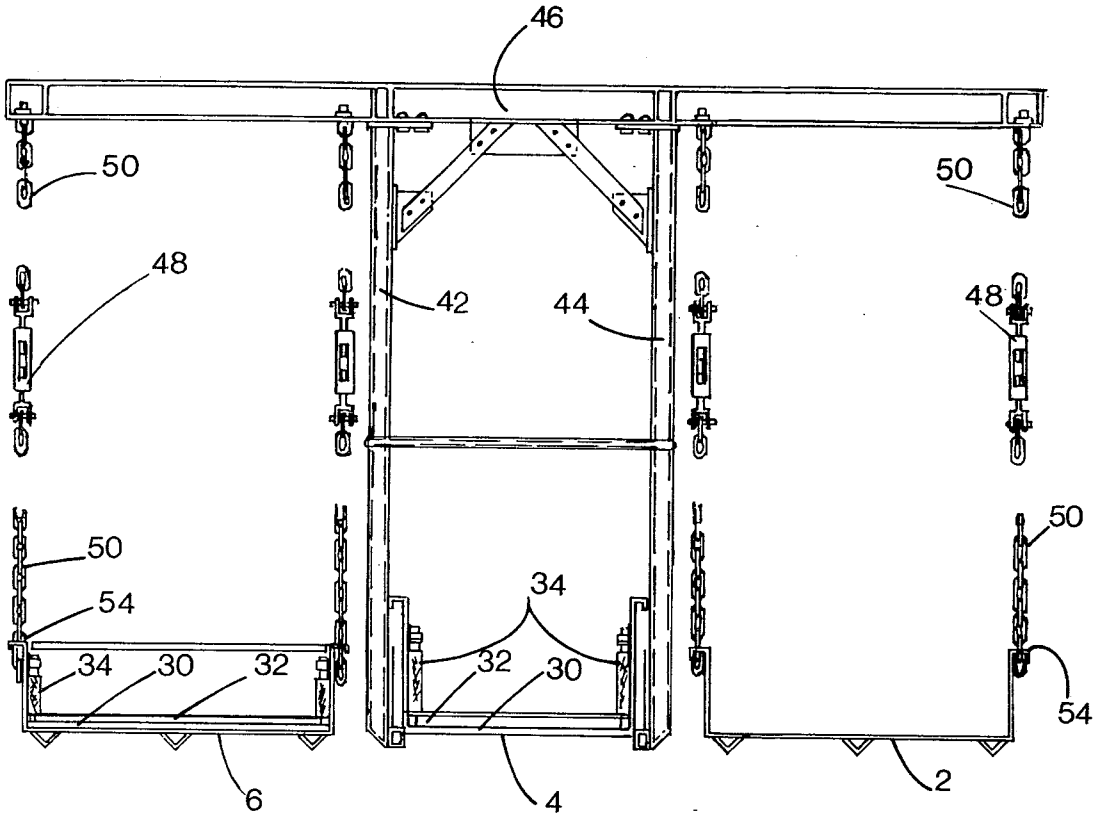
FIG. 4 is a sectional view taken along Line 4—4 of FIG. 1.

Each of the channels 2, 4 and 6 is preferrably constructed of steel plate forming a channel shaped section as best seen in FIG. 4. These recovery channels comprise sluices generally according to the prior art. Matting 30 is placed along the bottom of the channels and indoor/outdoor carpeting is preferred for this purpose. Expanded metal 31 extends over the matting. Riffles 32, comprising laterally extending lengths of angle section, are position on top of the expanded metal. The matting, expanded metal and riffles are held in position against the bottom of the channels by the lengths of timber 34 extending longitudinally along the sides of the channels. The timbers are held down by pegs 36 wedged between the timbers and lugs 38 welded to the sides of the channels, as seen in FIG. 2. A walkway grating 40 covers channels 2 and 6.

In the operational position, the hopper is inclined downwardly and the recovery channels are downwardly inclined away from the hopper. The hinged connections 18, 20 and 22 comprise means for independently varying the downward inclination of the recovery channels and it is desirable to provide means for adjustably securing the inclinations of the fine channels relative to the coarse channel. For this purpose, as best seen in FIGS. 2 and 4, the apparatus includes a support comprising a pair of upstanding members 42 and 44 secured at their lower ends to the coarse recovery channel 4. The support also includes a horizontal beam 46 mounted on the top ends of the members 42 and 44 and which extends above the fine recovery channels 2 and 6. Four tension members comprising turnbuckles 48 and chains 50 are suspended from the beam 46. There are slots 52 in the laterally extending flanges 54 of the fine recovery channels as seen in FIG. 1. The slots 52 are capable of receiving different links of the chains 50 and therefore provide means for varying the length of the tension members between the beam 46 of the support and the flanges. The inclinations of the fine recovery channels can thus be adjusted to the desired amount and then held in position. Fine adjustment and leveling of channels 2 and 6 is achieved by adjusting turnbuckles 48.

Referring in more detail to the hopper 8, like the recovery channels it is preferably constructed of heavy steel sections and plates because this sluice box apparatus is primarily designed for large scale placer mining and heavy use. The hopper has upstanding side walls which extend from the bottom 16 to the top 56 of the hopper. There are a pair of parallel side walls 58 and 60 near the rear or receiving end of the hopper and a pair of side walls 62 and 64 extending therefrom which converge towards a coarse material discharge opening 66 at a discharge end of the hopper and adjacent the coarse recovery channel 4. The rear of the hopper is open down to the laterally extending pipe or tube 68 so that aggregate can be added by a bulldozer or the like. The pipe or tube 68 provides strength should the blade of the bulldozer contact the apparatus. A step is formed from below pipe 68 to the bottom 16 of the hopper by the inclined plate 70 and the vertical plate 72, as shown in FIG. 2. An abrasion resistant perforated plate 74 with perforations 75 is coplanar with the inclined plate 70, is spaced-apart above the bottom 16 and supported in the inclined position by angle iron welded to the perimeter of the inside of the hopper and a gridwork of flat steel bars inside the hopper. The perforated plate 74 extends from side to side and from plate 70 to the unperforated V-shaped plate 78 adjacent the coarse material opening 66. The V-shaped plate has a top surface coplanar with the perforated plate 74. Plate 74 is downwardly inclined towards the discharge.

The distributing table formed by the bottom 16 of the hopper is divided into a plurality of U-shaped channels 79, 80, 82 and 84 formed by a plurality of spaced-apart U-shaped vanes 86, 88 and 90 which curve laterally across the hopper and extend to each of the converging hopper walls 62 and 64 and to the fine recovery channels 2 and 6. The V-shaped unperforated plate 78 extends between the innermost channel 84, the converging walls 62 and 64 and the coarse discharge opening 66. A V-shaped vane 92 defines the edge of channel 84 adjacent plate 78.

The hopper 8 is made in two sections, namely a rear section 94 and a front section 96 joined together by a plurality of bolts 98. As seen in FIG. 2, the two sections are joined between the side walls 58 and 60 and the converging side walls 62 and 64. By removing the bolts, the hopper may be knocked down into two sections for transport. The rigidity of the hopper is improved by a plurality of longitudinally extending ribs 100 comprising box-sectioned members which act as skids.

The converging side walls 62 and 64 have tops which slope downwardly toward the recovery channels, for example the top 102 of wall 62 is shown in FIG. 2. The apparatus has water distributing means comprising a manifold 104 extending laterally across the hopper and mounted on the top of the walls 62 and 64. The manifold 104 has a plurality of nozzles 106 for directing pressurized water onto material within the hopper on perforated plate 74. The water may be supplied, for example, by a standard diesel powered pump. U-bolts 108 are used for securing the manifold to the tops of the walls. The U-bolts are connected to the tops of the walls by a plurality of lugs 109 with bolt holes 110 so that the position of manifold 104 can be varied. For example, manifold 104 may be placed in the two positions shown in broken outline, or the position shown in solid lines in FIG. 2. Because of the sloping top of the walls 62 or 64, the manifold can be moved closer or further from the bottom of the hopper as well as closer or further from the coarse discharge opening 66.

Figure 5:
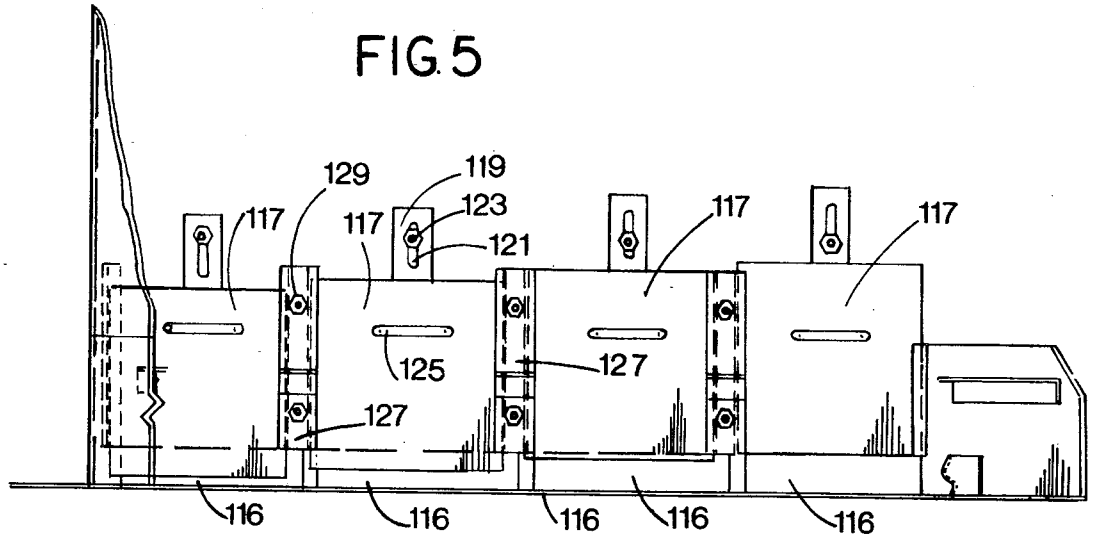
FIG. 5 is a fragmentary elevational view of the hopper showing the fine material openings and baffles.

As seen best in FIG. 1, there are portions 112 and 114 of the bottom 16 of the hopper which extend forwardly from the converging walls 62 and 64, forming forward portions of the channels together with vanes 86, 88, 90 and 92. In order to permit fine material passing through the perforated plate 74 to enter the fine recovery channels 2 and 6, there is a plurality of fine material openings 116 in the walls 62 and 64 as seen in FIG. 1 and FIG. 5. As outlined in more detail below, the fine material openings 116 are of a size to limit the amount of water which can flow through the walls 62 and 64 to the fine recovery channels 2 and 6. In the preferred embodiment, the openings 116 are rectangular. Each of the fine material discharge openings 116 is between the bottom 16 of the hopper and the perforated plate 74. As best seen in FIG. 1, each of the fine discharge openings is between a pair of the vanes 86, 88, 90 and 92. Referring to FIG. 5, each of the fine material discharge openings is provided with a vertically slidable baffle 117 for adjusting the effective size of the opening. The baffle over each opening is a rectangular plate with a tab 119 affixed to the top thereof. Each tab has a slot 121 through which passes a nut and threaded stud 123 welded to wall 62 or 64. When the nut is loose, the vertical position of the baffle can be changed using the handle 125 of each baffle. Vertical guides 127 are provided at the ends of the baffles. The guides are connected to wall 62 by threaded studs and nuts 129. In the prefered embodiment, the vertically slidable baffles 117 provide means for restricting the flow of water through the fine discharge openings to the fine recovery channels. However, the means for so restricting the flow could simply be fine material discharge openings of restricted size cut in the walls 62 and 64. In this case, no adjustment of the opening sizes would be possible.

In its knocked down condition with the hopper 8 divided into its two sections and with the three recovery channels removed, the apparatus can be transported easily, for example by a truck. Once at the placer mining site, the hopper is assembled by installing bolts 98 and the recovery channels are connected by hinge pins 21. The manifold 104, support members 44 and beam 46 are also installed. The ribs 100 along the bottom of the hopper act as skids for dragging the apparatus to the correct position, preferably on a suitably sloped earth ramp or embankment. In the operational position, the bottom 16 of the hopper slopes downwardly from the back or receiving end of the hopper adjacent pipe or tube 68 to the discharge end adjacent coarse discharge opening 66. The outer end of coarse recovery channel 4 is blocked so that the coarse recovery channel is at the required downward slope. The slope of the fine recovery channels is then set by fitting the appropriate links of the chains 50 in the slots 52 on the flanges 54 of the channels and leveling by means of turnbuckles 48. The manifold 104 is connected to a water pump so that water is discharged from nozzles 106.

A bulldozer can then be used to charge aggregate at a relatively constant rate into the receiving end of the hopper over pipe or tube 68. Because of the slope of plate 70 and perforated plate 74, as well as the water from manifold 104, the aggregate moves downwardly towards the coarse discharge opening 66 of the hopper. In the process, fine materials are washed from the aggregate and pass through the perforations 75 of plate 74 onto the distributing table formed by the bottom 16 of the hopper and the vanes. The vanes and U-shaped channel tend to distribute the slurry and direct the flow towards the fine recovery channels 2 and 6. The coarse material passing over perforated plate 74 eventually reaches the V-shaped plate 78 and passes through the coarse discharge opening 66 into the coarse recovery channel 4.

The fine material passing through the perforations in plate 74 moves along the U-shaped channels towards the walls 62 and 64 and the fine recovery channels. The fine material and water must pass through the fine discharge openings 116 to reach the fine recovery channels. Because the fine aggregate material is relatively heavy, it will move downwardly along the bottom, which is inclined since the sluice box is placed on a downwardly sloping ramp, to the openings 116 and pass through these openings to the fine recovery channels. However, by using adjustable baffles 117, the openings 116 can be adjusted to a size to limit the flow of water to the fine recovery channels. The flow may be limited to such an extent that the water is forced to recirculate upwardly through the perforations 75 in the plate adjacent the opening 66 at the discharge end of the hopper. This upwardly circulating water performs a second washing operation on the coarse aggregate moving downwardly along the perforated plate 74 and tends to wash off additional fines, for example gold, which then pass downwardly through the perforations in plate 74 and through the openings 116 to the fine recovery channels. This increases the percentage of fines diverted to the fine recovery channels instead of passing into the coarse recovery channel with the coarse material. The fine recovery channels may be more specifically adapted for efficient recovery of gold fines, particularly by adjusting the inclination of the fine recovery channels as permitted by the preferred embodiment of the invention. The slope of the fine recovery channels may be more gradual than the coarse recovery channel because a high velocity of water is not required to carry coarse material to the ends of these channels. Accordingly, fine gold particles are more likely to be caught by the riffles, expanded metal and matting of these channels. The volume flow of water to the fine recovery channels required for proper recovery of the fines and the amount of water passing upwardly through perforations 75 to perform the second washing of the aggregate can be adjusted by moving the baffles 117. As seen in FIG. 5, however, the baffles do not contact the bottom 16 of the hopper even in their lowest position, so a minimum flow of water to the fine recovery channels is assured.

As discussed above, the coarse material passing over the perforated plate 74 flows over the unperforated plate 78 and through the coarse material discharge opening 66. The preferred embodiment of the invention includes an additional feature to recovery additional fines. A second perforated plate 120 is positioned on the coarse recovery channel 2 adjacent the unperforated plate 78 so that their adjacent ends are coplanar. This permits additional fine material mixed with the coarser material to pass downwardly and be caught by the riffles 32 below the second perforated plate. The coarser material, including larger gold nuggets, passes over the second perforated plate and down the coarse recovery channel where the larger gold particles will be caught by riffles in this channel.

The present invention offers significant advantages when compared with earlier sluice box apparatuses, such as disclosed in Canadian Pat. No. 1,074,273 to Ross. For example, by having discharge openings between the hopper and the fine recovery channels which have a size that can be restricted, water can circulate upwardly through the coarse material again adjacent the discharge end of the hopper and wash additional fines which pass through the perforated plate and then to the fine recovery channels. Additional fines can be trapped by the riffles near the receiving end of the coarse recovery channel because of the second perforated plate 120 over this end of the coarse recovery channel.

Although Ross discloses the possibility of independently adjusting the slopes of the fine and coarse recovery channels, he does not disclose how this can be accomplished. The hinged connections on the receiving ends of the recovery channels, as found in the present invention, is a rugged, simple and efficient means of adjusting the slope of the fine recovery channels relative to the coarse recovery channel. Furthermore, the support structure comprising members 44 and beam 46 together with the tension members comprising turnbuckles 48 and chains 50 provide a useful system for securing the inclination and leveling of the fine channels relative to the coarse channel. The proper inclination of the recovery channel can be tested by panning the material leaving the discharge ends of the channels. The slope of the fine recovery channels or the coarse recovery channel is reduced if a significant amount of gold is found in the waste material. Since the slope of the channels is independently adjustable, the slope of the fine channels can be less than that of the coarse recovery channel for efficient recovery of the gold fines.

The means for adjusting the position of the manifold including the sloping top of the walls 62 and 64 and the plurality of bolt holes 110 in lugs 109 for the U-bolts 108, means that manifold 104 can be properly positioned for efficient watering. The position can be changed according to the nature of the aggregate entering the hopper or according to the efficiency of the washing as observed.

The effectiveness of the present invention in recovering gold, particularly fines, is such that the superfine recovery sections on the fine recovery channels of the Ross device are not required. Such features as channels having individually adjustable angles of inclination and the provision of adjustable baffles 117 account for this.

In addition, since perforated plate 74 is downwardly inclined relative to bottom 16, the hopper can be placed on a ramp having a relatively small inclination to slow the slurry and still permit the efficient discharge of coarse material out the coarse material discharge opening 66. The distribution section floor which is transversely downwardly inclined and longitudinally upwardly inclined in the Ross device is not required because of the shallow angle of the bottom.

What is claimed is:

1. A sluice box apparatus for recovering heavy material, such as gold, the apparatus comprising:

(a) a fine recovery channel and a coarse recovery channel, the recovery channels each having a receiving end, riffles, and matting for collecting fines of said material;

(b) a hopper adjacent the receiving ends of the channels having a receiving end for aggregate, a wall for retaining the aggregate, a discharge end adjacent the receiving ends of the channels, a bottom, an open top, a perforated plate extending substantially across the hopper near the discharge end, the plate being spaced-apart from the bottom, a coarse material discharge opening in the wall adjacent the coarse recovery channel for a flow of water and aggregate passing over the perforated plate to the coarse recovery channel, the coarse material discharge opening being above the perforated plate when the apparatus is positioned for use, and a fine material discharge opening means in the wall between the bottom and the perforated plate and adjacent the fine recovery channel, the fine material discharge opening means allowing a flow of water and fine material passing through the perforated plate to enter the fine recovery channel;

(c) water distributing means near the top and the discharge end of the hopper for washing fines from the aggregate; and (d) means for adjusting the fine material discharge opening means to a size which limits the flow of water to the fine recovery channel to such an extent that water recirculates upwardly through the perforated plate to aggregate on the perforated plate and washes additional fines from the aggregate.

2. An apparatus as claimed in claim 1, the wall extending from the bottom of the hopper to the top, the fine material discharge opening means extending from the bottom of the hopper towards the perforated plate.

3. An apparatus as claimed in claim 2 wherein said fine material discharge opening means comprises a plurality of fine material discharge openings along the wall adjacent the fine recovery channel.

4. An apparatus as claimed in claim 1, the means for adjusting comprising an adjustable baffle over the fine material discharge opening means.

5. An apparatus as claimed in claim 4, the baffle comprising a vertically slidable rectangular plate.

6. An apparatus as claimed in claim 1 comprising an additional fine recovery channel, the fine recovery channels being on opposite sides of the coarse recovery channel and parallel thereto, there being a pair of said hopper walls on opposite sides of the coarse material discharge opening, the walls converging towards the coarse material discharge opening, each of the fine recovery channels having the receiving end adjacent one of the walls, said fine material discharged opening means comprises a plurality of spaced-apart fine material discharge openings extending through each said wall towards the adjacent fine recovery channel.

7. An apparatus as claimed in claim 6 comprising U-shaped channels on the bottom of the hopper formed by a plurality of spaced-apart U-shaped vanes curving laterally across the hopper and extending to each of the converging hopper walls, the vanes extending between the bottom of the hopper and the perforated plate, each of the fine discharge openings being between a pair of vanes.

8. An apparatus as claimed in claim 7, the means for adjusting comprising an adjustable baffle over each said fine material discharge opening.

9. An apparatus as claimed in claim 8, each said baffle comprising a vertically slidable rectangular plate.

10. An apparatus as claimed in claim 7 comprising an innermost U-shaped channel near the coarse material discharge opening, the hopper comprising a flat, unperforated plate having a top surface coplanar with the perforated plate and extending between the innermost channel, the converging walls and the coarse discharge opening.

11. An apparatus as claimed in claim 10 comprising a second perforated plate on the coarse recovery channel adjacent the unperforated plate, the coarse recovery channel comprising riffles below the second perforated plate.

12. An apparatus as claimed in claim 1 or claim 6, the recovery channels being downwardly inclined away from the hopper when the apparatus is in use, the apparatus comprising hinged connections on the receiving ends of the recovery channels adjacent the hopper for independently varying the downward inclination of the recovery channels.

13. An apparatus as claimed in claim 12, the hinged connections comprising removable pins so the apparatus can be knocked down for transport.

14. An apparatus as claimed in claim 13, the hopper comprising two sections secured together by bolts which are removable to knock down the hopper into said two sections for transport.

15. An apparatus as claimed in claim 6, the recovery channels being downwardly inclined away from the hopper when the apparatus is in use, the apparatus comprising hinged connections on the recovery channels adjacent the hopper for independently varying the downward inclination of the recovery channels, the apparatus comprising means for adjustably securing the inclination of the fine channels relative to the coarse channel.

16. An apparatus as claimed in claim 15, the means for securing comprising a support mounted on the coarse recovery channel near an end thereof opposite the hopper, the support extending over the fine recovery channels, tension members suspended from the support, means for securing the tension members to the fine recovery channels and means for varying the lengths of the tension members between the support and said securing means.

17. An apparatus as claimed in claim 16, the support comprising upstanding members secured at lower ends thereof to the coarse recovery channel and a horizontal beam mounted on top ends of the members and extending above the fine recovery channels, the tension members comprising chains suspended below the beam, the means for securing and the means for varying comprising slots in laterally extending flanges of the fine recovery channels for receiving different links of the chains.

18. An apparatus as claimed in claim 1, the water distributing means comprising a manifold extending laterally across the hopper with a plurality of spaced-apart nozzles for directing pressurized water onto the material, the apparatus comprising means for adjusting the position of the manifold.

19. An apparatus as claimed in claim 18, the hopper having side walls with downwardly sloping tops, the apparatus comprising brackets for securing the manifold to the tops of the side walls, the means for adjusting the position of the manifold comprising a plurality of positions on the tops of the side walls receiving the brackets.

20. An apparatus as claimed in claim 1, the matting comprising indoor-outdoor carpeting.

21. An apparatus as claimed in claim 1, the perforated plate being downwardly inclined towards the discharge end of the hopper with respect to the bottom.

22. An apparatus as claimed in claim 1, wherein the means for adjusting comprises a plate which is slidable over the fine material discharge opening means to partially block said fine material discharge opening means.

* * * * *